US006694580B1

(12) United States Patent
Hatzold

(10) Patent No.: US 6,694,580 B1
(45) Date of Patent: Feb. 24, 2004

(54) MAIL ALERT

(76) Inventor: Thomas Hatzold, 9316 Cloverly Rd., Philadelphia, PA (US) 19114

( * ) Notice: Subject to any disclaimer, the term of this patent is extended or adjusted under 35 U.S.C. 154(b) by 0 days.

(21) Appl. No.: 10/411,035

(22) Filed: Apr. 9, 2003

Related U.S. Application Data

(60) Provisional application No. 60/371,835, filed on Apr. 12, 2002.

(51) Int. Cl.[7] ..... B65D 91/00
(52) U.S. Cl. ..... 27/36; 340/569
(58) Field of Search ..... 232/35, 36; 340/569, 340/568.1

(56) References Cited

U.S. PATENT DOCUMENTS

| | | | | | |
|---|---|---|---|---|---|
| 837,770 | A | | 12/1906 | Allen | |
| 3,611,333 | A | * | 10/1971 | Conigliaro | 340/539.14 |
| 3,707,260 | A | * | 12/1972 | Gelineau et al. | 232/36 |
| 4,154,393 | A | * | 5/1979 | Darvishian | 232/36 |
| 4,163,225 | A | * | 7/1979 | Engel | 340/569 |
| 4,287,514 | A | * | 9/1981 | Wartman et al. | 340/569 |
| 4,520,350 | A | * | 5/1985 | Huang | 340/569 |
| 4,794,377 | A | * | 12/1988 | Benages | 340/569 |
| 4,872,210 | A | | 10/1989 | Benages | |
| 5,023,595 | A | | 6/1991 | Bennett | |
| 5,239,305 | A | * | 8/1993 | Murphy et al. | 340/539.1 |
| 5,950,919 | A | * | 9/1999 | Adams | 232/34 |
| 5,979,751 | A | * | 11/1999 | Maddox | 232/52 |
| 6,459,375 | B1 | * | 10/2002 | Wallace | 340/569 |

* cited by examiner

*Primary Examiner*—William L. Miller
(74) *Attorney, Agent, or Firm*—Matthew J. Peirce

(57) ABSTRACT

A mail notification system for use with structures and residences is disclosed. The mail notification system comprises an activator attachment that is attached to an inner surface of a mailbox. The activator attachment includes an activator that is kept in a retracted position by a flange attached to a mailbox door when the mailbox door is shut. Once the mailbox door is opened, the activator opens to an extended position, thereby activating a radio wave transmitter in the activator attachment. The radio wave transmitter emits radio waves that are picked up by a radio wave receiver that is incorporated into a face plate unit that is preferably located within a residence of an individual. The radio wave receiver then activates a speaker to emit sounds and an attached display to display words that indicate the mailbox door has been opened, suggesting mail has been deposited in the mailbox.

3 Claims, 1 Drawing Sheet

MAIL ALERT

I. BACKGROUND OF THE INVENTION

Priority is hereby claimed to application Ser. No. 60/371,835, filed on Apr. 12, 2002.

The present invention concerns that of a new and improved mail notification system for use with structures and residences.

II. DESCRIPTION OF THE PRIOR ART

U.S. Pat. No. 5,023,595, issued to Bennett, discloses a solar-powered transmitter for providing a signal when mail has arrived.

U.S. Pat. No. 4,872,210, issued to Benages, discloses a signal device mounted on the inside of a mail box and capable of emitting a radio signal to a receiver and alert inside a residence in the event that the door is opened.

U.S. Pat. No. 837,770, issued to Allen, discloses an announcement system for a mailbox.

III. SUMMARY OF THE INVENTION

The present invention concerns that of a new and improved mail notification system for use with structures and residences. The mail notification system comprises an activator attachment that is attached to an inner surface of a mailbox. The activator attachment includes an activator that is kept in a retracted position by a flange attached to a mailbox door when the mailbox door is shut. Once the mailbox door is opened, the activator opens to an extended position, thereby activating a radio wave transmitter in the activator attachment. The radio wave transmitter emits radio waves that are picked up by a radio wave receiver that is incorporated into a face plate unit that is preferably located within a residence of an individual. The radio wave receiver then activates a speaker to emit sounds and an attached display to display words that indicate the mailbox door has been opened, suggesting mail has been deposited in the mailbox.

There has thus been outlined, rather broadly, the more important features of a mail notification system that the detailed description thereof that follows may be better understood and in order that the present contribution to the art may be better appreciated. There are, of course, additional features of the mail notification system that will be described hereinafter and which will form the subject matter of the claims appended hereto.

In this respect, before explaining at least one embodiment of the mail notification system in detail, it is to be understood that the mail notification system is not limited in its application to the details of construction and to the arrangements of the components set forth in the following description or illustrated in the drawings. The mail notification system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present mail notification system. It is important, therefore, that the claims be regarded as including such equivalent constructions insofar as they do not depart from the spirit and scope of the present invention.

It is therefore an object of the present invention to provide a mail notification system which has all of the advantages of the prior art and none of the disadvantages.

It is another object of the present invention to provide a mail notification system which may be easily and efficiently manufactured and marketed.

It is another object of the present invention to provide a mail notification system which is of durable and reliable construction.

It is yet another object of the present invention to provide a mail notification system which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
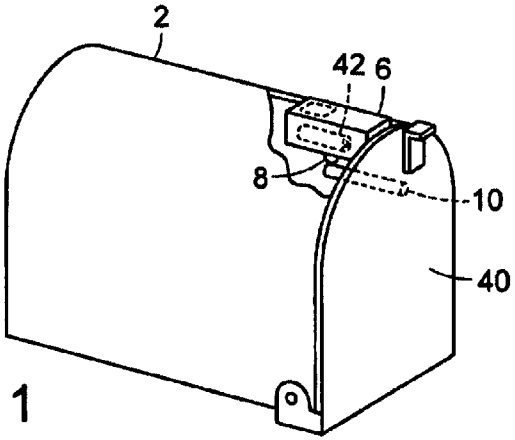
FIG. 1 shows a perspective view of a mailbox prior to being opened.
Figure 2:
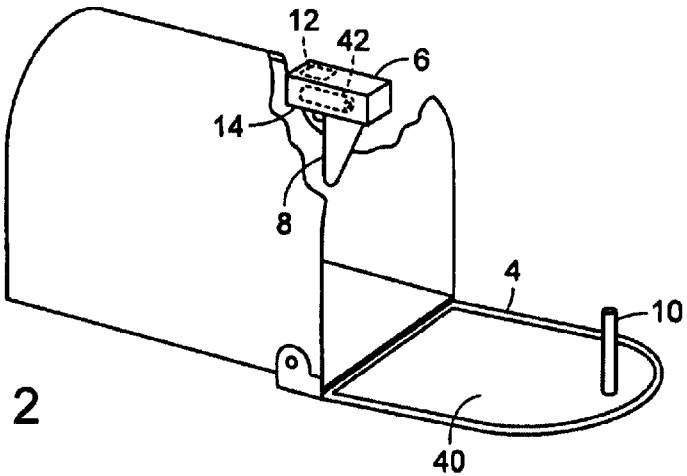
FIG. 2 shows a perspective view of a mailbox after being opened.

FIG. 1 shows a perspective view of a mailbox 2 prior to being opened, while FIG. 2 shows a perspective view of a mailbox 2 after the mailbox door 4 has been opened. The mailbox 2 has two ends, a front end and a rear end, and also has at least one inner surface. Mailbox door 40 is pivotally attached to the front end of the mailbox 2, with the mailbox door 40 having two surfaces, an inner surface and an outer surface.

Mailbox 2 has activator holder 6 attached to a part of the inner surface of the mailbox 2, with activator 8 being spring-tensioned within activator holder 6 by spring 42. Activator 8 has two positions comprising an inner position and an extended position. Spring 42 has two ends comprising a first end and a second end, with the first end of the spring 42 attached to the inner surface of the mailbox 2 and the second end of the spring 42 attached to the activator. Spring 42 normally provides an outward-pushing force upon activator 8, attempting to keep the activator 8 in the extended position or push it toward the activator position. Activator 8 is shaped like an upside-down cone.

The inner surface of mailbox door 4 has an attached flange 10. When the mailbox door 4 is closed, flange 10 forces activator 8 to be placed into the inner position within activator holder 6. When mailbox door 4 is opened, flange 10 is released from contact with activator 8 and then spring 42 pushes activator 8 into the extended position, due to the spring tensioning within activator holder 6 by spring 42.

Mailbox 2 also has an incorporated transmitter 12 with power means 14, with power means 14 preferably being at least one battery. Transmitter 12 would preferably be located within activator holder 6 or immediately adjacent to it, and when activator 8 would be placed into an open position by the opening of mailbox door 4, transmitter 12 would transmit radio waves of a specific frequency.

Figure 3:
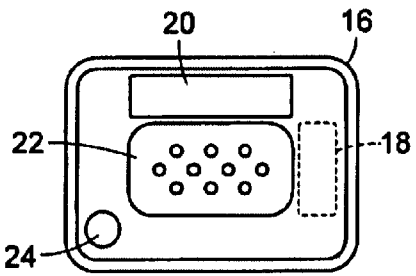
FIG. 3 shows a front view representation of the face plate incorporated into a residence or structure.

FIG. 3 shows a front view representation of the face plate 16. Face plate 16 is preferably located within a few hundred feet of the activator 8 and would be incorporated into a residence or structure. Face plate 16 has two surfaces, a front surface and a rear surface, with face plate 16 having an incorporated receiver 18, a display screen 20, and a speaker 22. The display screen 20 and the speaker 22 are located on the front surface of the face plate 16.

When receiver 18 would receive radio waves from transmitter 12, the face plate 16 would display on display screen 20 a written message to the effect of "You Got Mail" or "Mail Alert." In addition, the speaker 22 would speak the words placed on a display screen 20. After these words would be spoken, the speaker 22 would emit a bell or buzzer sound to continually remind a user that mailbox door 4 had just been opened, likely signally the arrival of mail within mailbox 2.

Alternatively, face plate 16 could have a front-mounted button 24, when depressed, would stop the bell or buzzer from emitting further sounds. This button 24 would allow a user to stop the continual notification by face plate 16 of having just received mail, while at the same time, allow a user to get the mail in mailbox 2 at a later time.

What I claim as my invention is:

1. A mail notification system comprising:

(a) a mailbox, the mailbox having at least one inner surface, the mailbox having two ends, a front end and a rear end, (b) a mailbox door pivotally attached to the front end of the mailbox, the mailbox door having two surfaces, an inner surface and an outer surface, (c) an activator holder attached to the inner surface of the mailbox near the front end of the mailbox, (d) an activator attached to the activator holder, the activator having two positions, an inner position and an extended position, (e) spring tensioning means for pushing the activator outward into an extended position, (f) a flange attached to the inner surface of the mailbox door, the flange keeping the activator in an inner position while the mailbox door is shut, (g) a radio wave transmitter incorporated into the activator holder, the radio wave transmitter designed to emit radio waves of a specific wavelength or wavelengths, (h) power means for providing power to the radio wave transmitter, (i) a face plate mounted within a few hundred feet of the activator holder, the face plate having two surfaces, a front surface and a rear surface, the face plate preferably mounted within a residence, a radio wave receiver incorporated into the face plate, the radio wave receiver designed to recognize and receive the radio waves of the specific wavelength or wavelengths emitted from the radio wave transmitter, (k) a display screen mounted to the front surface of the face plate, (l) a speaker mounted to the front surface of the face plate, (m) wherein the flange depresses the activator inward when the mailbox door is shut, and (n) further wherein the mailbox door is pulled open, the flange pulls away from the activator, whereby the spring tensioning means causes the activator to push outward, further wherein the radio wave transmitter emits the radio waves, further wherein the radio wave receiver on the face plate will recognize and receive the radio waves emitted from the radio wave transmitter, and further wherein the radio wave receiver then activates the speaker to emit sound and the display to display words indicating the opening of the mailbox.

2. A mail notification system according to claim 1 wherein the spring tensioning means comprises a spring with two ends, a first end and a second end, the first end of the spring attached to the inner surface within the mailbox, the second end of the spring attached to the activator.

3. A mail notification system according to claim 2 wherein the power means for providing power to the radio wave transmitter further comprise at least one battery.

* * * * *